US006044878A

United States Patent [19]

Sedeno

[11] Patent Number: 6,044,878

[45] Date of Patent: Apr. 4, 2000

[54] MONEY PURSE

[76] Inventor: Delphine Sedeno, 385 Pinhill Rd., Hillsborough, Calif. 94010

[21] Appl. No.: 09/116,971

[22] Filed: Jul. 16, 1998

[51] Int. Cl.[7] ..... A45C 1/00; A45C 13/10

[52] U.S. Cl. ..... 150/101; 150/118; 150/152; 383/72; 383/76

[58] Field of Search ..... 150/101, 102, 150/118, 133, 100, 150, 152; 383/72, 73, 76

[56] References Cited

U.S. PATENT DOCUMENTS

| | | | |
|---|---|---|---|
| 265,893 | 10/1882 | Town | 150/101 |
| 440,191 | 11/1890 | Peterson | 150/101 |
| 774,584 | 11/1904 | Harms | 383/76 X |
| 933,332 | 9/1909 | Noren | 150/101 |
| 979,303 | 12/1910 | Horsfall | 150/101 |
| 1,096,537 | 5/1914 | Humphreys | 383/76 X |
| 1,342,432 | 6/1920 | Eaton | 383/76 X |
| 1,807,826 | 6/1931 | Brady | 150/101 |
| 2,431,030 | 11/1947 | Edwards | 383/76 X |
| 2,487,145 | 11/1949 | Kuhlman | 383/76 X |
| 3,981,339 | 9/1976 | Arnold | 150/133 |
| 5,560,429 | 10/1996 | Needham | 383/72 X |

*Primary Examiner*—Sue A. Weaver

[57] ABSTRACT

A money purse for holding items such as money. The purse includes front and back panels coupled together to define therebetween a space with a top opening for holding items therein. The back panel has a cover flap extending therefrom for covering the top opening. The cover flap has a plurality of spaced apart holes therethrough while the front panel has a plurality of elongate flexible strings extending therefrom. Each of the strings is extended through an associated hole such that the strings extend across the top opening into the space between the front and back panels. Each of said strings has a free end coupled to a pull ring.

7 Claims, 4 Drawing Sheets

MONEY PURSE

BACKGROUND OF THE INVENTION

1. Field of the Invention

The present invention relates to money purses and pouches and more particularly pertains to a new money purse for holding items such as money.

2. Description of the Prior Art

The use of money purses and pouches is known in the prior art. More specifically, money purses and pouches heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,409,153; U.S. Pat. No. 5,069,261; U.S. Pat. No. Des. 244,885; U.S. Pat. No. 3,272,248; U.S. Pat. No. 1,600,633; and U.S. Pat. No. 5,392,974.

While these devices fulfill their respective, particular objectives and requirements, the aforementioned patents do not disclose a new money purse. The inventive device includes front and back panels coupled together to define a space with a top opening therebetween for holding items therein. The back panel has a cover flap extending therefrom for covering the top opening. The cover flap has a plurality of spaced apart holes therethrough while the front panel has a plurality of elongate flexible strings extending therefrom. Each of the strings is extended through an associated hole such that the strings extend across the top opening into the space between the front and back panels. Each of said strings has a free end coupled to a pull ring.

In these respects, the money purse according to the present invention substantially departs from the conventional concepts and designs of the prior art, and in so doing provides an apparatus primarily developed for the purpose of holding items such as money.

SUMMARY OF THE INVENTION

In view of the foregoing disadvantages inherent in the known types of money purses and pouches now present in the prior art, the present invention provides a new money purse construction wherein the same can be utilized for holding items such as money.

The general purpose of the present invention, which will be described subsequently in greater detail, is to provide a new money purse apparatus and method which has many of the advantages of the money purses and pouches mentioned heretofore and many novel features that result in a new money purse which is not anticipated, rendered obvious, suggested, or even implied by any of the prior art money purses and pouches, either alone or in any combination thereof.

To attain this, the present invention generally comprises front and back panels coupled together to define a space with a top opening therebetween for holding items therein. The back panel has a cover flap extending therefrom for covering the top opening. The cover flap has a plurality of spaced apart holes therethrough while the front panel has a plurality of elongate flexible strings extending therefrom. Each of the strings is extended through an associated hole such that the strings extend across the top opening into the space between the front and back panels. Each of said strings has a free end coupled to a pull ring.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new money purse apparatus and method which has many of the advantages of the money purses and pouches mentioned heretofore and many novel features that result in a new money purse which is not anticipated, rendered obvious, suggested, or even implied by any of the prior art money purses and pouches, either alone or in any combination thereof.

It is another object of the present invention to provide a new money purse which may be easily and efficiently manufactured and marketed.

It is a further object of the present invention to provide a new money purse which is of a durable and reliable construction.

An even further object of the present invention is to provide a new money purse which is susceptible of a low cost of manufacture with regard to both materials and labor, and which accordingly is then susceptible of low prices of sale to the consuming public, thereby making such money purse economically available to the buying public.

Still yet another object of the present invention is to provide a new money purse which provides in the apparatuses and methods of the prior art some of the advantages thereof, while simultaneously overcoming some of the disadvantages normally associated therewith.

Still another object of the present invention is to provide a new money purse for holding items such as money.

Yet another object of the present invention is to provide a new money purse which includes front and back panels coupled together to define a space with a top opening therebetween for holding items therein. The back panel has a cover flap extending therefrom for covering the top opening. The cover flap has a plurality of spaced apart holes therethrough while the front panel has a plurality of elongate flexible strings extending therefrom. Each of the strings is extended through an associated hole such that the strings extend across the top opening into the space between the front and back panels. Each of said strings has a free end coupled to a pull ring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
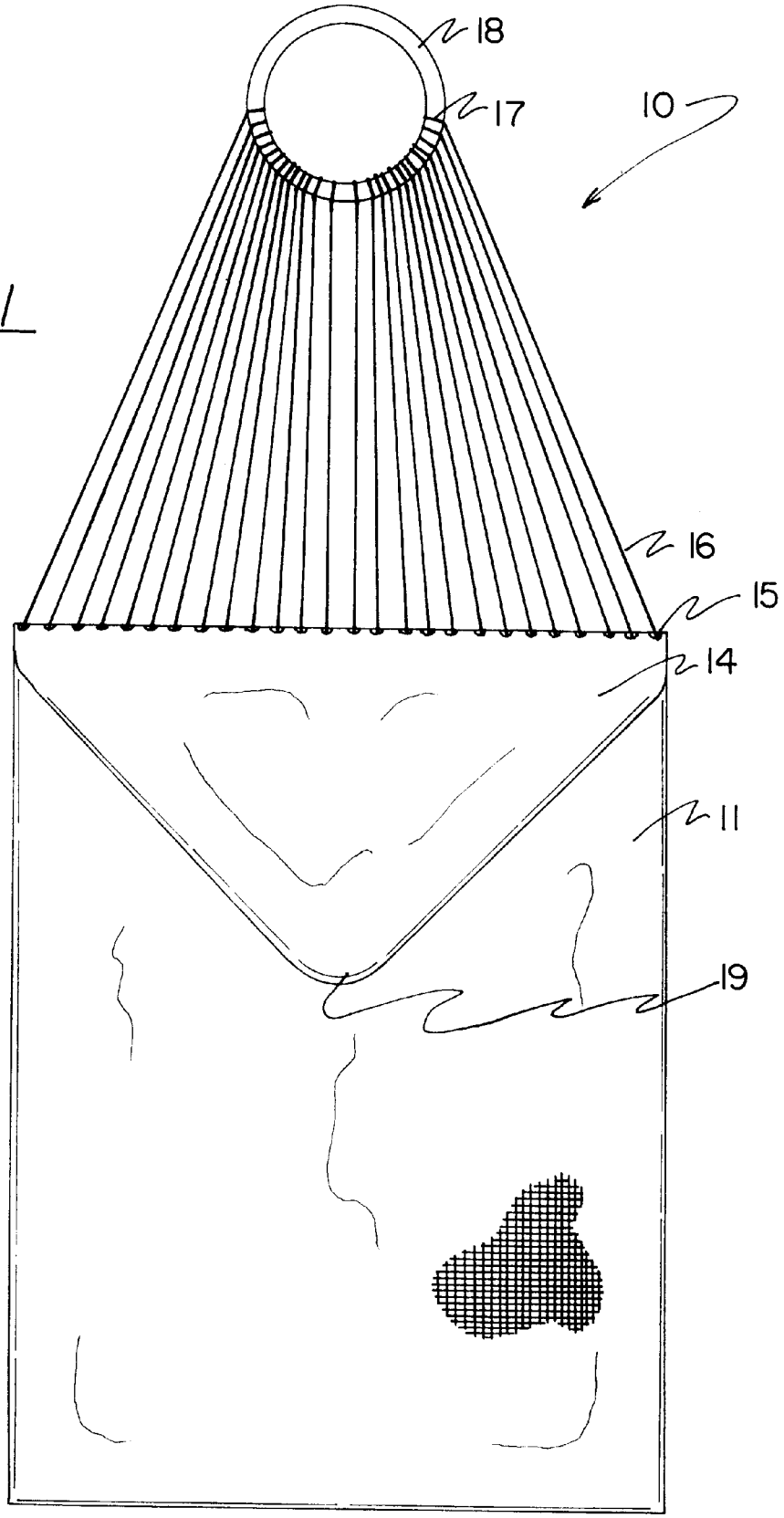
FIG. 1 is a schematic front side view of a new money purse according to the present invention with the cover flap covering the top opening.

With reference now to the drawings, and in particular to FIGS. 1 through 5 thereof, a new money purse embodying the principles and concepts of the present invention and generally designated by the reference numeral 10 will be described.

As best illustrated in FIGS. 1 through 5, the money purse 10 generally comprises front and back panels 11,12 coupled together to define therebetween a space with a top opening 13 for holding items therein. The back panel 12 has a cover flap 14 extending therefrom for covering the top opening 13. The cover flap 14 has a plurality of spaced apart holes 15 therethrough while the front panel 11 has a plurality of elongate flexible strings 16 extending therefrom. Each of the strings 16 is extended through an associated hole such that the strings 16 extend across the top opening 13 into the space between the front and back panels 11,12. Each of said strings 16 has a free end 17 coupled to a pull ring 18.

In closer detail, the purse 10 includes front and back panels 11,12, each having an outer perimeter comprising upper and lower ends and a pair of sides extending between the upper and lower ends. The front and back panels 11,12 preferably are each generally rectangular although optionally they may be several other shapes including circular, triangular, diamond-shaped, and heart shaped. The front and back panels 11,12 are coupled together along the sides and lower ends of the front and back panels 11,12 to define a space therebetween for holding items such as money therein. The upper ends of the front and back panels 11,12 define a top opening 13 into the space between the front and back panels 11,12. The back panel 12 has a cover flap 14 extending from the upper edge of the back panel 12. Preferably, the cover flap 14 is generally triangular and is designed for covering the top opening 13 into the space between the front and back panels 11,12. The cover flap 14 has a plurality of spaced apart holes 15 therethrough. The holes 15 are extended in a row of holes 15 between the sides of the back panel 12 adjacent the upper edge of the back panel 12. The front panel 11 has a plurality of elongate flexible strings 16 extending from the upper edge of the front panel 11. Each of the strings 16 is extended through an associated hole 15 such that the strings 16 extend across the top opening 13 into the space between the front and back panels 11,12. Ideally, the plurality of holes 15 comprises 26 holes 15, Ideally, the plurality of strings 16 comprises 26 strings 16. The free ends 17 of the strings 16 are coupled to a generally circular pull ring 18. Ideally, the purse comprises a flexible woven fabric material such that the front panel 11 and the strings 16 are integrally connected and the cover flap 14 and the back panel 12 are integrally connected.

Figure 2:
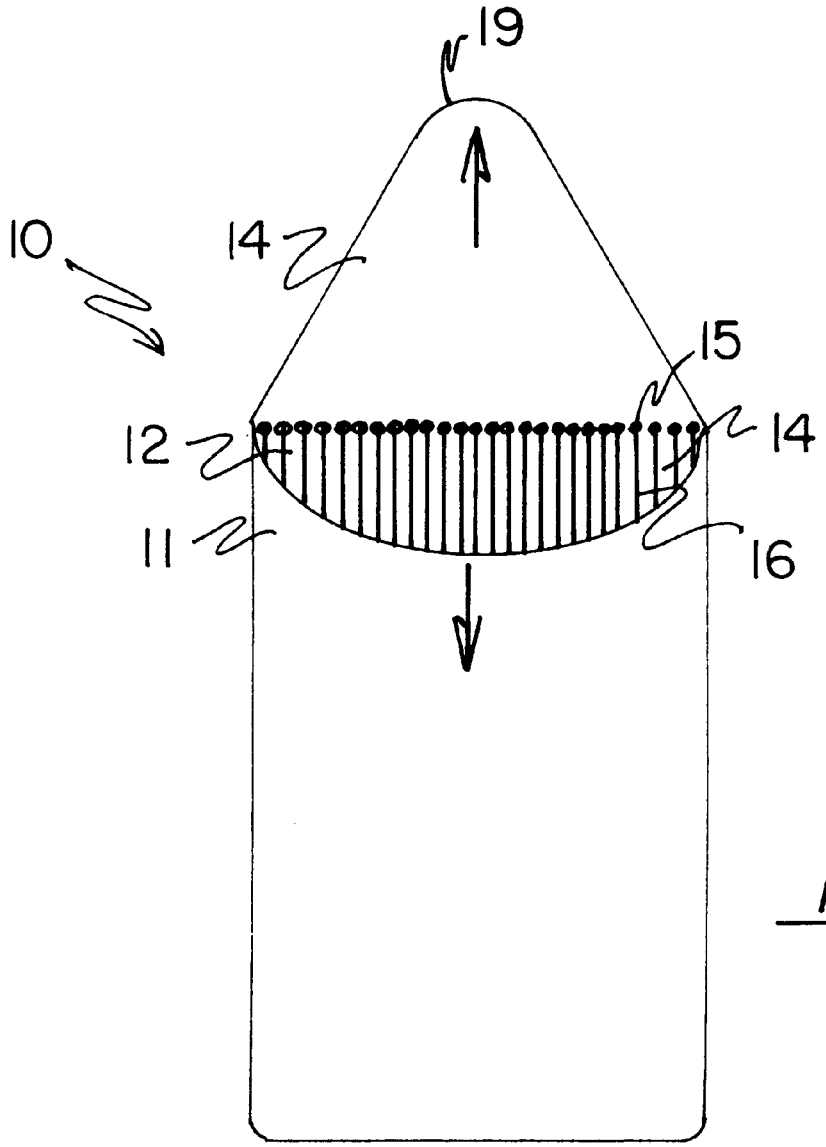
FIG. 2 is a schematic front side view of the present invention with the cover flap lifted to expose the top opening.
Figure 3:
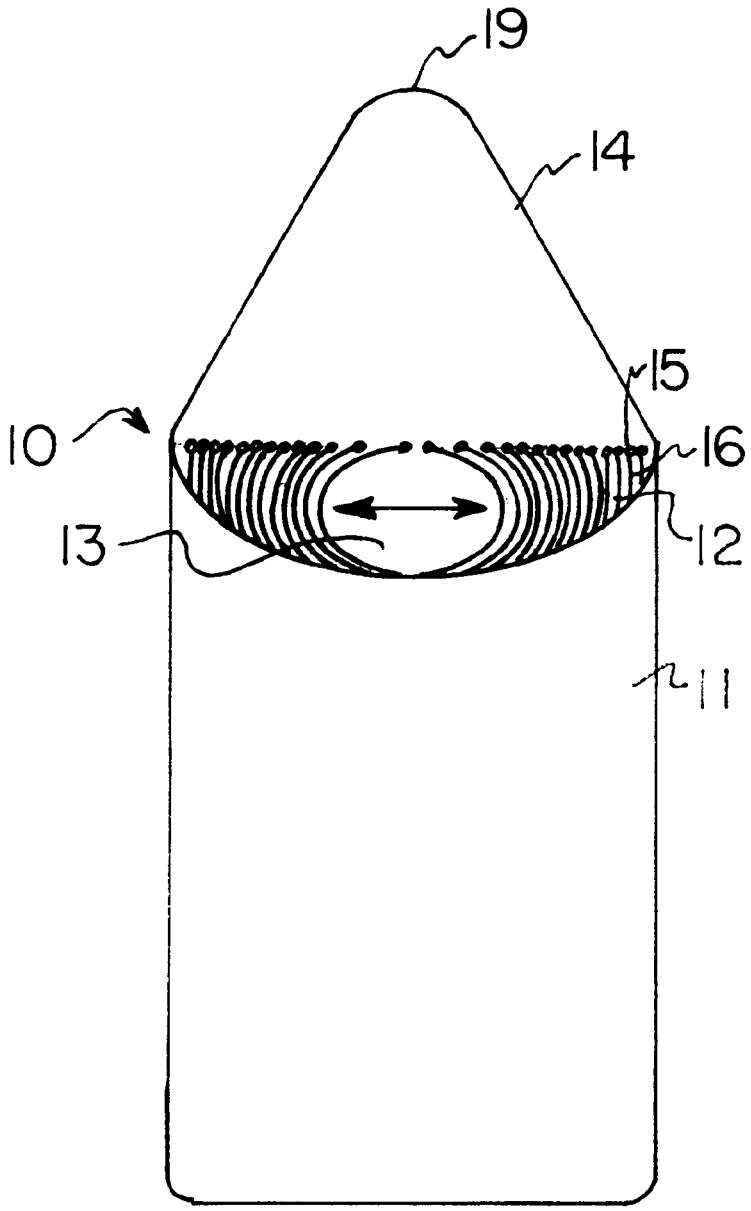
FIG. 3 is a schematic front side view of the present invention illustrating the moving apart of the strings to provide access through the top opening into the space between the front and back panels.
Figure 4:
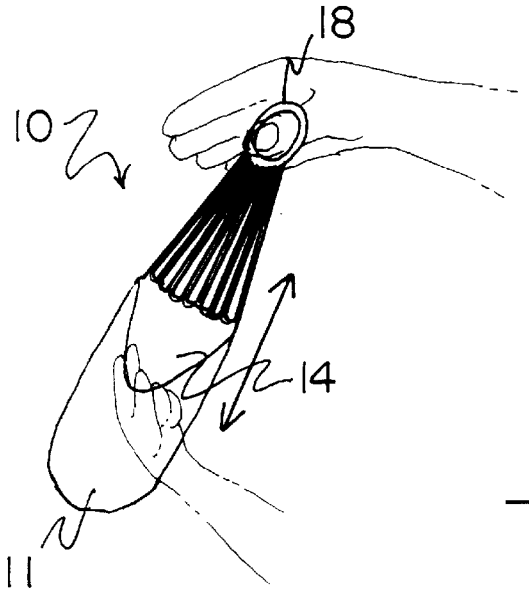
FIG. 4 is a schematic perspective view of the present invention being closed.
Figure 5:
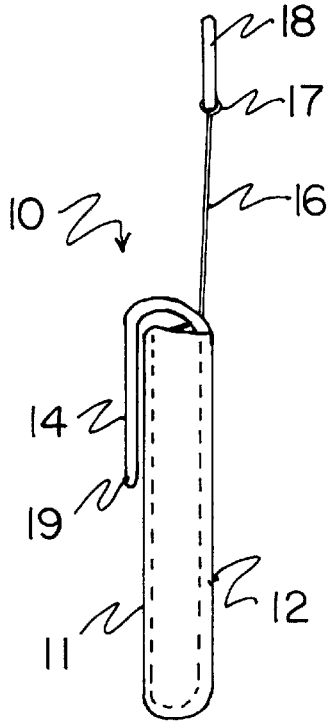
FIG. 5 is a schematic side view of the present invention.

In use, the purse 10 is opened by pulling on the free vertex 19 of the cover flap and the upped edge of the front panel 11 as illustrated in FIG. 2 so that the strings 16 slide through it so that the cover panel is positioned towards the pull ring 18. The portions of the strings 16 between the front and back panels 11,12 may then pulled apart as illustrated in FIG. 3 to permit access through the top opening 13 into the space between the front and back panels 11,12. As illustrated in FIG. 4, the purse may be closed by grasping the pull ring 18 and the free vertex 19 of the cover flap 14 and pulling the cover flap 14 down towards the front panel 11 so that the top opening 13 is covered by the cover flap 14. Optionally, the cover flap 14 may have a fastener such as a hook and loop-type fastener or a snap fastener to hold the free vertex 19 of the cover flap 14 to the front panel 11 when the cover panel is covering the top opening 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A purse, comprising:

front and back panels being coupled together to define a space therebetween for holding items therein, said front and back panels forming a top opening into said space between said front and back panels;

said back panel having a cover flap for covering said top opening extending therefrom;

said cover flap having a plurality of spaced apart holes therethrough;

said front panel having a plurality of elongate flexible strings extending therefrom, each of said strings being associated with a hole of said cover flap, each of said strings being extended through the associated hole such that said strings extend across said top opening into said space between said front and back panels; and each of said strings having a free end coupled to a pull ring.

2. The purse of claim 1, wherein each of said panels is generally rectangular and has an outer perimeter comprising upper and lower ends and a pair of sides extending between said upper and lower ends, said front and back panels being coupled together along said sides and lower ends of said front and back panels to define said space therebetween, said upper ends of said front and back panels defining said top opening into said space between said front and back panels.

3. The purse of claim 2, wherein said cover flap extends from said upper edge of said back panel.

4. The purse of claim 3, wherein said holes are extended in a row of holes between said sides of said back panel adjacent said upper edge of said back panel.

5. The purse of claim 1, wherein said cover flap is generally triangular.

6. The purse of claim 1, wherein said plurality of holes comprises 26 holes, and wherein said plurality of strings comprises 26 strings.

7. A purse, comprising:

front and back panels, each of said panels being generally rectangular and having an outer perimeter comprising upper and lower ends and a pair of sides extending between said upper and lower ends;

said front and back panels being coupled together along said sides and lower ends of said front and back panels to define a space therebetween for holding items therein, said upper ends of said front and back panels defining a top opening into said space between said front and back panels;

said back panel having a cover flap extending from said upper edge of said back panel, said cover flap being generally triangular, said cover flap being for covering said top opening into said space between said front and back panels;

said cover flap having a plurality of spaced apart holes therethrough, said holes being extended in a row of holes between said sides of said back panel adjacent said upper edge of said back panel;

said front panel having a plurality of elongate flexible strings extending from said upper edge of said front panel, each of said strings being associated with a hole of said cover flap, each of said strings being extended through said associated hole such that said strings extend across said top opening into said space between said front and back panels;

wherein said plurality of holes comprises 26 holes, wherein said plurality of strings comprises 26 strings;

each of said strings having a free end distal said upper edge of said front panel; and a generally circular pull ring, said free ends of said strings being coupled to said pull ring.

* * * * *